United States Patent [19]

Zimmer

[11] Patent Number: 4,923,367

[45] Date of Patent: May 8, 1990

[54] SUBMERSIBLE PUMP WITH PLASTIC HOUSING

[75] Inventor: John E. Zimmer, Churubusco, Ind.

[73] Assignee: Flint & Walling, Inc., Kendallville, Ind.

[21] Appl. No.: 167,924

[22] Filed: Mar. 14, 1988

[51] Int. Cl.[5] ..... F04D 29/22

[52] U.S. Cl. ..... 415/199.1; 415/214.1; 415/912

[58] Field of Search ..... 416/241 R, 241 A; 415/DIG. 3, 214, 219 R, 219 C, DIG. 5, 912, 915, 214.1, 217.1, 199.1, 199.2, 199.3

[56] References Cited

U.S. PATENT DOCUMENTS

| | | | |
|---|---|---|---|
| Re. 25,569 | 5/1964 | Coron et al. | 415/190 |
| 2,706,451 | 4/1955 | Mayer-Ortiz et al. | 415/190 |
| 2,775,945 | 1/1957 | Aruntunoff . | |
| 3,238,879 | 3/1966 | Shallenberg | 415/199.2 X |
| 3,241,493 | 3/1966 | Frey | 415/214 X |
| 3,265,001 | 8/1966 | Deters | 415/173 R |
| 3,477,384 | 11/1969 | Hlinka | 415/214 |
| 3,521,970 | 7/1970 | Deters | 415/214 |
| 3,612,716 | 10/1971 | Deters | 415/140 |
| 3,656,861 | 4/1972 | Zagar | 415/214.1 X |
| 3,676,013 | 7/1972 | Albertson | 415/128 |
| 3,730,641 | 5/1973 | Gordon | 415/214 X |
| 3,779,668 | 12/1973 | Ekey | 416/241 A X |
| 4,052,133 | 10/1977 | Yeater | 415/214.1 X |
| 4,098,558 | 7/1978 | Bush et al. | 415/DIG. 3 X |
| 4,172,690 | 10/1979 | Kuntz | 415/199.2 |
| 4,278,399 | 7/1981 | Erickson | 415/199.1 |
| 4,281,964 | 8/1981 | Jinkins | 415/DIG. 5 X |
| 4,406,582 | 9/1983 | LaGrange | 415/214 |
| 4,706,928 | 11/1987 | Hyll | 249/184 |

OTHER PUBLICATIONS

Crane-Deming, "Unitized Split-Shell Submersible Pumps".

*Primary Examiner*—Everette A. Powell, Jr.

*Attorney, Agent, or Firm*—Edgar A. Zarins; Malcolm L. Sutherland

[57] ABSTRACT

A submersible pump having a plastic housing and adapted to accommodate multiple pump stages. The housing includes a pair of housing halves which enclose the impeller cartridges of the pump and an adjustment cone to retain the impeller cartridges for proper operation. Different length housings to accommodate a varying number of impeller stages are manufactured from the same mold utilizing removable inserts to vary the length of the mold. Accordingly, substantially integral housing halves can be formed at a substantial reduction in cost.

19 Claims, 2 Drawing Sheets

SUBMERSIBLE PUMP WITH PLASTIC HOUSING

BACKGROUND OF THE INVENTION

I. Field of the Invention

This invention relates to a submersible pump construction and, in particular, to a multi-stage submersible pump with a variable length plastic housing to vary the number of stages and a method of manufacturing the housing.

II. Description of the Prior Art

Multi-stage submersible pumps are widely known and utilized in both commercial and residential applications. Such pumps use multiple pumping stages mounted to a rotating shaft to pump the fluid from one end of the pump to the other. The pumping requirements determine the number of stages in the pump and as a result pump housings of different lengths must be utilized for the different size pumps to accommodate the stages. In past known pump constructions, the housing includes an inlet head which is attached to the drive motor, a discharge head and a casing sleeve normally constructed of stainless steel. By varying the length of the casing sleeve a different number of stages can be accommodated to increase pump performance. The cartridge assembly consisting of the individual pumping stages is compressed between the inlet and discharge heads to control leakage between the stages. Although reducing the costs associated with the manufacture of multi-stage pumps, such constructions can have significant weight associated therewith since normally the inlet head and discharge head are made of cast iron or brass.

In an attempt to reduce the weight of the pump as well as manufacturing costs, plastic components have been substituted in past known pumps. Plastic impellers and diffusers are utilized to provide the multiple stages of the pump. Such impellers and diffusers are in the form of stages which stack on the shaft whereby they are forceably engaged to control fluid leakage between the stages which results in better pump performance and efficiency as a result of lower fluid pressure on the interior of the housing. Attempts to provide a plastic housing have not met with total success either because of fluid leakage or the limited number of stages which may be incorporated. Past known plastic housing pumps have molded the diffuser plate into the housing while segregating the pump stages which results in leakage between the housing halves and decreased pump efficiency as a result of the fluid loss.

The one advantage that the stainless steel sleeve housings had over the past known plastic housings is the capability of accommodating a wide range of impeller stages simply by manufacturing sleeves of different lengths. In contrast, a different mold had to be made for the different sized plastic housings resulting in increased inventory and manufacturing costs.

SUMMARY OF THE PRESENT INVENTION

The present invention overcomes the disadvantages of the prior known pump constructions by providing a two-piece plastic pump housing assembly which minimizes fluid leakage while reducing manufacturing costs by providing the flexibility to accommodate multiple stages.

The pump assembly includes a two-piece plastic housing which incorporates both the inlet head or mounting ring and the discharge head. A stainless steel hexagonal shaft is drivably connected to the motor mounted to the lower end of the housing and extends axially through the housing to drive the individual stages. The pump stages consist of a diffuser plate and diffuser cup which cooperate to house the impeller disk. An example of such a pump stage is shown in U.S. Pat. No. 3,730,641. The stages are stacked on top of each other to form the cartridge of the pump and are held in engagement with each other by an adjustment cone connected to the top of the shaft and adjustably disposed within the discharge head of the housing. The adjustment cone eliminates the need for the housing to maintain engagement between the stages. The housing halves are assembled by bolts which extend through mating flanges formed as part of the housing halves. A cable guard through which the motor cable passes may also be provided.

The plastic housing halves are manufactured in such a manner that production of housings having different lengths to accommodate multiple stages is not cost prohibitive. The mold utilized to form the housing halves include removable intermediate inserts which can be utilized to vary the length of the housing. By inserting additional mold parts, the housing is lengthened and vice-versa. The ends of the mold remain the same but are merely spaced apart by the inserts. Thus, only one mold needs to be manufactured in order to produce different length housings.

Other objects, features, and advantages of the invention will be apparent from the following detailed description taken in connection with the accompanying drawing.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
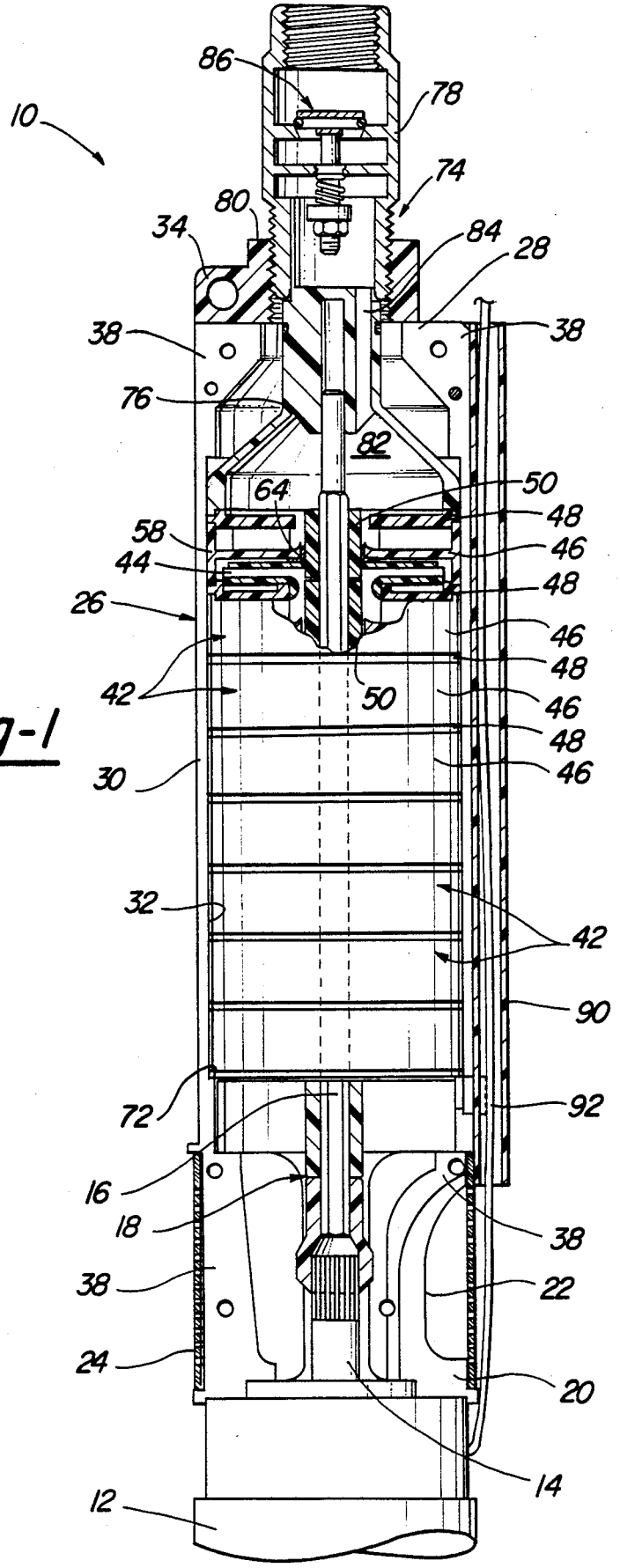
FIG. 1 is a side perspective view of the submersible pump embodying the present invention in partial cross-section.
Figure 2:
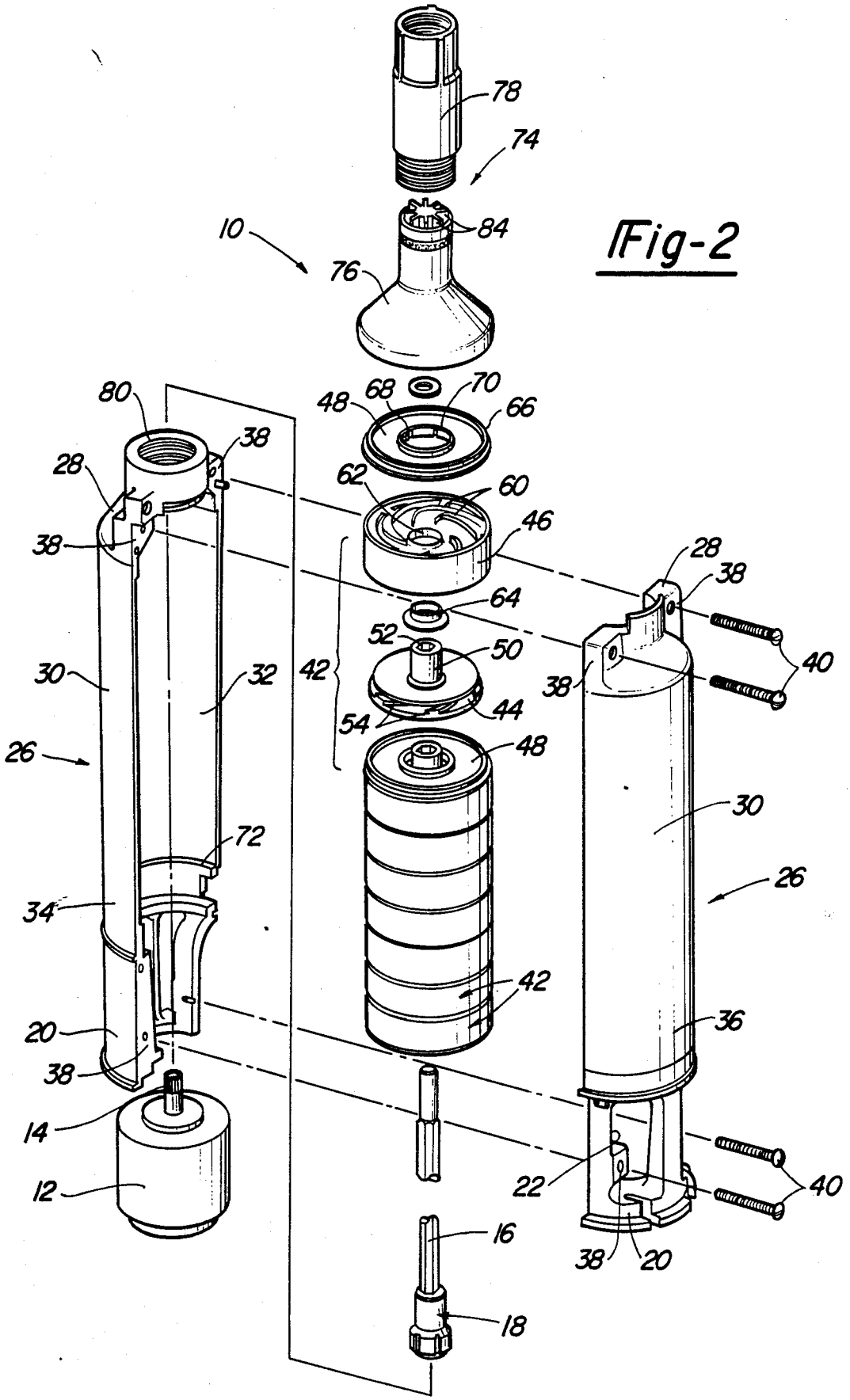
FIG. 2 is an exploded elevational perspective of the submersible pump embodying the present invention.

Referring generally to both FIGS. 1 and 2, there is shown a multi-stage submersible pump 10 embodying the present invention. The pump 10 is adapted to be connected at one end to a drive motor 12 having a motor shaft 14. An impeller shaft 16 of hexagonal cross-section is coupled to the motor shaft 14 for rotation therewith by means of a sleeve coupler 18 splined to the shaft 14 and connected to the shaft 16. The impeller shaft 16 extends axially through the pump 10 to drive the impeller assemblies as will be subsequently described. The motor 12 is connected to the pump 10 at the lower or inlet end of the pump 10 which includes a substantially cylindrical inlet head 20. The inlet head 20 includes a plurality of enlarged water inlet openings 22 around the circumference thereof. Conventionally, a screen 24 covers the openings 22 to filter any large debris particles as the water flows into the inlet head 20.

The inlet head 20 forms an integral portion of the pump housing 26 which also includes an integral discharge head 28 formed at the other end thereof. The pump housing 26 has a conventional cylindrical intermediate portion 30 which forms an internal chamber 32 extending from the inlet head 20 to the discharge head 28. In a preferred embodiment of the present invention, the pump housing 26, including the integral inlet head 20 and discharge head 28, is molded from a plastic material in order to reduce manufacturing costs while also reducing the overall weight of the pump 10. The housing 26 is preferably molded into two separate mold halves 34 and 36, as shown in FIG. 2, which are attached to form the full pump housing 26. Both the inlet head 20 and the discharge head 28 are provided with a plurality of flanges 38 adapted to receive connecting bolts 40 to matingly secure the housing halves 34 and 36. Thus, the housing 26 of the pump 10 comprises a two-piece plastic housing having the inlet and discharge heads formed substantially integrally therewith.

Referring still to FIGS. 1 and 2, within the cylindrical chamber 32 of the housing 26 are mounted a plurality of pumping stages 42 in contiguous stacked relation on the impeller shaft 16. Each pumping stage 42 consists of a centrifugal impeller disk 44, a diffuser cup 46 and a diffuser plate 48. The pumping stages 42 are preferably formed of plastic materials having non-fusing properties in order to reduce the weight of the pump 10 while ensuring smooth, efficient operation. Examples of the cartridges herein described are disclosed in U.S. Pat. No. 3,730,641.

The impeller disks 44 have a central hub 50 provided with a hexagonal bore 52 for a sliding fit with the impeller shaft 16. The impeller disk 44 includes a plurality of vanes 54 for directing fluid flow centrifugally outwardly as the impeller shaft 16 rotates the impeller disk 44. The impeller disk 44 has a water inlet opening 56 of larger diameter than and coaxial with the hub 50.

The diffuser cup 46 has a cylindrical shell portion 58 and essentially flat surface on one side with radial vanes 60 formed on the other side. The radial vanes 60 define fluid passageways which terminate in a plurality of circumferentially spaced openings at the perimeter. A central circular opening 62 fitted with a metal bushing 64 is sized to provide a running fit with hub 50 of the impeller disk 44.

The diffuser plate 48 for one stage is positioned to overlie the diffuser vanes 60 therebelow to enclose the diffuser passageways. The plate periphery includes an annular rabbet 66 to provide locating shoulders to properly position the plate in the stacked assembly. An enlarged central opening 68 in the diffuser plate 48 is defined by an annular wear ring 70 which engages the impeller disk 44 to provide a fluid seal. As shown in FIG. 1, the pump stages 42 are stacked with the impeller hubs 50 in abutting engagement.

The pumping stages 42 are disposed within the cylindrical chamber 32 of the housing 26 in contiguous stacked relation to form a cartridge assembly with the shaft 16 extending therethrough to drive the impeller disks 44. An annular shoulder 72 is provided on the inner periphery of the housing 26 upon which the cartridge assembly is seated. The shoulder 72 engages the bottom end cartridge to prevent downward movement of the stack and to provide an abutment surface against which the cartridge assembly is retained. The sleeve coupler 18 provides axial support of the cartridge assembly to retard axial thrust during operation. The impeller cartridges 42 are adjustably pressed against the shoulder 72 by cartridge adjustment means 74 which includes an adjustment cone 76 and a discharge valve assembly 78. While the adjustment cone 76 is matingly received within the end of the discharge valve assembly 78, the valve 78 is threadably retained within an annular neck 80 formed as part of the discharge head portion 28 of housing half 34. Positional adjustment of the cone 76 is accomplished by rotating the discharge valve 78 to accordingly move the valve 78 into and out of the neck 80. As a result, the cone 76 will exert pressure on the top end stage 42 to thereby positionally capture the cartridge assembly between the cone 76 and the shoulder 72. In this manner, the diffuser assembly is prevented from rotating while the shaft 16 rotates the impeller 44 to facilitate fluid flow.

The adjustment cone 76 also acts as a funnel to direct fluid flow from the cartridge stack into the discharge valve assembly 78. The cone 76 includes a substantially frusto-conical chamber 82 and at least one fluid passageway 84 which directs flow from the chamber 82 into the discharge valve 78. In a preferred embodiment, the discharge valve assembly 78 includes a poppet valve 86 as shown in FIG. 1 although other valve types would work equally as well. A cable guard 90 may also be integrally formed with or separately attached to the housing 26 in order to provide a protective cover for the operating cable 92 of the motor 12.

In operation, the pump 10 is commonly utilized in an upright position with the discharge head 28 disposed at the top. With the motor 12 operating to rotate the impeller shaft 16, the individual impeller disks 44 will rotate. Water is drawn through the screen 24, the openings 22 and the inlet into the first pump stage 42 through the passageway 56. Water is centrifuged outwardly and passes into the diffuser vane passages between the vanes 60 to the central opening 68 in the diffuser plate 48. The water flows into the next stage 42 for continued forceful movement through the succeeding pump stages 42. As water flows from the top pump stage 42, the adjustment cone 76 funnels the water into the discharge valve assembly 78 for final discharge from the pump 10. Fluid leakage or recirculation is minimized by the contiguous abutment of adjacent pump stages 42, particularly the inner and outer periphery of the pump stages. The force with which the adjacent stages engage each other can be selectively adjusted using the adjustment means 74. Since recirculation/leakage is minimized and the number of stages in the pump can be varied to accommodate the particular application. Moreover, the plastic housing 26 of the present invention can be utilized without concern for leakage through the seams of the housing 26.

In order to properly accommodate a different number of pump stages, the housing length must be varied accordingly for efficient operation. In the past known stainless steel housings this was simply accomplished by varying the length of the cylindrical shell. Similarly, the length of the plastic housing 26 of the present invention can be altered by increasing or decreasing the length of the cylindrical chamber 32. However, because the inlet and discharge heads are integrally formed with the intermediate portion 30, variable length housings require different molds which is prohibitively expensive to accommodate all housing sizes. The present invention contemplates the use of a variable length mold to form the housing halves 34 and 36. The molds include an inlet head portion adapted to form the inlet head 20 of the housing 26 and a discharge head portion adapted to form the discharge head 28 of the housing 26. Selectively removable and insertable therebetween is at least one intermediate mold portion which has a substantially semi-cylindrical molding surface. The number of intermediate mold portions corresponds to the number of stages intended for the pump 10. As a result, plastic pump housings of different lengths can be formed without a significant increase in inventory and manufacturing costs. Molds for all the possible housing sizes are not necessary which allows for the use of a substantially integral plastic housing.

Thus, the present invention provides a full plastic housing for use in a submersible pump and an inexpensive method of manufacturing the housings to accommodate the multiple stages of the pump. The plastic housing 26 reduces the weight of the pump 10 as well as inhibiting corrosion due to the moisture environment normally encountered by such pumps. The practical use of the plastic housing is made possible in part by the impeller cartridges and the adjustment means which retain them and by the reduced cost of manufacturing the different length housings defined herein.

The foregoing detailed description has been given for clearness of understanding only and no unnecessary limitations should be understood therefrom as some modifications will be obvious to those skilled in the art without departing from the scope and spirit of the appended claims.

I claim:

1. A multi-stage submersible centrifugal pump comprising:

an impeller shaft adapted to be drivably rotated by a drive motor;

a cartridge assembly consisting of a plurality of pump stages drivably mounted to said shaft in contiguous stacked relation;

a plastic pump housing having a substantially cylindrical internal chamber adapted to house said cartridge assembly, said housing formed from a pair of mating housing halves having integral inlet and discharge head portions to form inlet and discharge heads of said housing upon joining said housing halves; and cartridge adjustment means connected to said impeller shaft, said means positionally capturing said cartridge assembly in contiguous stacked relation on said drive shaft to prevent longitudinal movement of said pump stages within said housing and ensure sealing engagement between pump stages.

2. The pump as defined in claim 1 wherein said housing chamber includes an annular shoulder adapted to engage a first end pump stage whereby said cartridge adjustment means adjustably secures said pump stages in contiguous stacked relation against said annular shoulder.

3. The pump as defined in claim 2 wherein said cartridge adjustment means comprises a cartridge adjustment cone adapted to engage a second end pump stage and a discharge valve assembly adjustably threadably mounted to said discharge head of said housing, said adjustment cone matingly received by said discharge valve assembly whereby axial adjustment of said discharge valve assembly within said discharge head of said housing axially adjusts said cone against said cartridge assembly to ensure sealing engagement between contiguous pump stages.

4. The pump as defined in claim 3 wherein said cartridge adjustment cone includes an internal fluid passageway communicating with said pump stages and said discharge valve assembly, said adjustment cone adapted to funnel fluid flow from said pump stages into said discharge valve assembly.

5. The pump as defined in claim 3 wherein said housing halves include securement flanges proximate the inlet head portion and the discharge head portion of said housing halves for attaching said housing halves to form said pump housing.

6. The pump as defined in claim 5 wherein the discharge head portion of one of said housing halves includes an annular neck adapted to threadably receive said discharge valve assembly.

7. The pump as defined in claim 6 wherein said discharge valve assembly includes a poppet valve.

8. The pump as defined in claim 5 wherein said pump housing further comprises a cable guard secured to the exterior of said housing and extending substantially the length of said housing.

9. A multi-stage submersible centrigual pump comprising:

an impeller shaft adapted to be drivably rotated by a drive motor;

a plurality of impeller cartridges drivably mounted to said shaft in contiguous stacked relation, said plurality of impeller cartridges forming a cartridge assembly;

a plastic pump housing formed from a pair of mating housing halves, each having an inlet head portion and a discharge head portion, said housing halves including securement flanges proximate said inlet head portions and said discharge head portions for attaching said housing halves to form said pump housing, said pump housing having an internal chamber adapted to house said cartridge assembly intermediate said inlet head and said discharge head;

cartridge adjustment means disposed within said discharge head of said housing, said means positionally capturing said plurality of impeller cartridges in contiguous stacked relation against said inlet head of said housing to prevent longitudinal movement of said cartridges within said housing and ensure sealing engagement between contiguous impeller cartridges.

10. The pump as defined in claim 9 wherein said housing chamber includes an annular shoulder proximate said inlet head, a first end impeller cartridge seated against said annular shoulder whereby said cartridge adjustment means adjustably positions said impeller cartridges in contiguous stacked relation against said annular shoulder.

11. The pump as defined in claim 10 wherein said cartridge adjustment means comprises a cartridge adjustment cone adapted to engage a second end impeller cartridge and a discharge valve assembly adjustably mounted to said discharge head of said housing, said adjustment cone received by said discharge valve assembly whereby axial adjustment of said discharge valve assembly relative to said discharge head of said housing axially adjusts said cone against said cartridge assembly to ensure sealing engagement between contiguous impeller cartridges.

12. The pump as defined in claim 11 wherein said impeller cartridges comprise an impeller disk having a hub drivably mounted on said impeller shaft, a diffuser cup which receives for rotation therein said impeller disk, and a diffuser plate coöperating with said cup to define diffuser passageways, said diffuser plate having a central opening larger than said drive shaft, said diffuser cup and plate being held stationary by the force of said adjustment cone acting on said impeller cartridge stack while said impeller shaft rotates said impeller disk to provide fluid flow from said inlet head, through said impeller cartridge stack towards said discharge head.

13. The pump as defined in claim 12 wherein said cartridge adjustment cone includes an internal fluid passageway communicating with said cartridge assembly and said discharge valve assembly, said adjustment cone adapted to funnel fluid flow from said cartridge assembly into said discharge valve assembly.

14. The pump as defined in claim 11 wherein the discharge head portion of one of said housing halves includes an annular neck adapted to threadably receive said discharge valve assembly for axial adjustment thereof.

15. The pump as defined in claim 14 wherein said discharge valve assembly includes a poppet valve seated within an axial fluid passageway.

16. A multi-stage submersible centrifugal pump comprising:

an impeller shaft adapted to be drivably rotated by a drive motor;

a plurality of impeller cartridges drivably mounted to said shaft in contiguous stacked relation, said plurality of impeller cartridges forming a cartridge assembly;

a plastic pump housing formed from a pair of mating housing halves each having an inlet head portion and a discharge head portion, said housing halves forming an internal chamber adapted to house said cartridge assembly intermediate said inlet head and said discharge head; and cartridge adjustment means connected to said impeller shaft, said means positionally capturing said cartridge assembly in contiguous stacked relation on said drive shaft to prevent longitudinal movement of said cartridges within said housing and ensure sealing engagement between contiguous impeller cartridges.

17. The pump as defined in claim 16 wherein said housing chamber includes an annular shoulder adapted to engage a first end impeller cartridge whereby said cartridge adjustment means adjustably secures said impeller cartridges against said annular shoulder.

18. The pump as defined in claim 17 wherein said cartridge adjustment means comprises a cartridge adjustment cone adapted to engage a second end impeller cartridge and a discharge valve assembly adjustably threadably mounted to said discharge head of said housing, said adjustment cone matingly received by said discharge valve assembly whereby axial adjustment of said discharge valve assembly within said discharge head of said housing axially adjusts said cone against said cartridge assembly to ensure sealing engagement between contiguous impeller cartridges.

19. The pump as defined in claim 18 wherein cartridge adjustment cone includes an internal fluid passageway communicating with said impeller cartridges and said discharge valve assembly, said adjustment cone adapted to funnel fluid flow from said cartridge assembly into said discharge valve assembly.

* * * * *